United States Patent [19]

Recane et al.

[11] 4,415,951

[45] Nov. 15, 1983

[54] LAMPCHANGER

[75] Inventors: Marion L. Recane, Houston; William V. Burns, Austin; Charles E. McMillen; Dan G. Luce, both of Houston, all of Tex.

[73] Assignee: Tideland Signal Corporation, Houston, Tex.

[21] Appl. No.: 388,843

[22] Filed: Jun. 16, 1982

[51] Int. Cl.[3] ..... F21V 19/04

[52] U.S. Cl. ..... 362/20; 362/249; 362/250; 362/254; 362/276

[58] Field of Search ..... 362/20, 276, 249, 250, 362/254

[56] References Cited

U.S. PATENT DOCUMENTS

| | | | |
|---|---|---|---|
| 3,529,147 | 9/1970 | Badalich | 362/254 |
| 3,781,853 | 12/1973 | Jacobs | 340/29 |
| 3,964,040 | 6/1976 | Behl | 362/20 |
| 4,190,777 | 2/1980 | Luce et al. | 362/20 |
| 4,225,901 | 9/1980 | Luce | 362/20 |
| 4,225,901 | 9/1980 | Luce | 362/20 |

*Primary Examiner*—Stephen J. Lechert, Jr.
*Assistant Examiner*—Howard J. Locker
*Attorney, Agent, or Firm*—Fulbright & Jaworski

[57] ABSTRACT

A lampchanger preferably for use in a railroad signal lantern having a focusing lens which includes a horizontally rotatable turret adapted to support a plurality of lamps for indexing one of the lamps to the focal point of the lens. The turret includes a plurality of bayonet sockets for holding a lamp in which the sockets have resilient sides which taper inwardly away from the turret body for accurately securing the lamp in position. The turret includes a contact insulator having a radially extending slot adjacent each of the sockets with a power contact positioned in each of the slots. Each power contact includes a circular ridge for engaging the bottom of a lamp positioned in a socket for cleaning and making a good contact with the lamp. A power brush engages the rotatable turret and is positioned to engage the power contact and engages the slot of the insulator positioned in lamp operating position for mechanically holding the turret in position. A light detector is directed at the lamp in position in the focal point for detecting whether the lamp is lighted. And motor means is connected to the turret for rotating the turret when the light detector detects a burned out lamp. The control circuit includes means for preventing rotation of the turret in the event of failure of the light detector and includes a binary counter for actuating the motor with a gated oscillator clocking the counter and a capacitor large enough to charge the circuit in the hold state if power is lost.

3 Claims, 6 Drawing Figures

LAMPCHANGER

BACKGROUND OF THE INVENTION

It is known to utilize lampchangers in certain applications such as navigational lights as shown in U.S. Pat. Nos. 3,781,853 and 4,225,901. However, the use of a railroad lampchanger signal lantern requires a different structure and operation. The present apparatus is directed to a lampchanger for use with the single contact bayonet base lamp commonly used in railroad signal lanterns and various improvements for use as a railroad signal lantern although it is useful in other applications.

SUMMARY

The present invention is directed to a lampchanger preferably for use in a railroad signal lantern having a focusing lens and includes a horizontally rotatable turret adapted to support a plurality of lamps for indexing one of the lamps to the focal point of the lens. The turret includes a plurality of bayonet sockets each of which is adapted to hold a bayonet base lamp. The sockets include resilient sides which taper inwardly away from the turret body for accurately accommodating and compensating for variations in lamp base diameter and for accurately securing the lamp in position. The turret includes a contact insulator having a radially extending slot adjacent each of the sockets. A power contact is positioned in each of the slots and each power contact includes a circular ridge for engaging and biting into the bottom of a lamp positioned in a socket for cleaning and making a good contact with the lamp. A power brush engages the rotatable turret and is positioned to engage the power contact of the lamp positioned in the focal point and engages the slot of that power contact for mechanically holding the turret in position with the lamp at the focal point of the lens. A light detector is directed at the lamp in position in the focal point of the lens for detecting whether the lamp is lighted or burned out. And motor means are connected to the turret for rotating the turret when the light detector detects a burned out lamp.

The present invention is further directed to including a control circuit connected to the motor means including means for preventing rotation of the turret in the event of a failure of the light detector in order to prevent the signal lantern from making an unintended flashing signal.

Still a further object of the present invention is wherein the motor is a two-phase four coil unipolar motor and includes a control circuit which includes a binary counter actuating the coils, a gated oscillator connected to and clocking said counter for holding the counter in count in the event of loss of power, and a capacitor large enough to charge the circuit in the hold state until power is regained.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
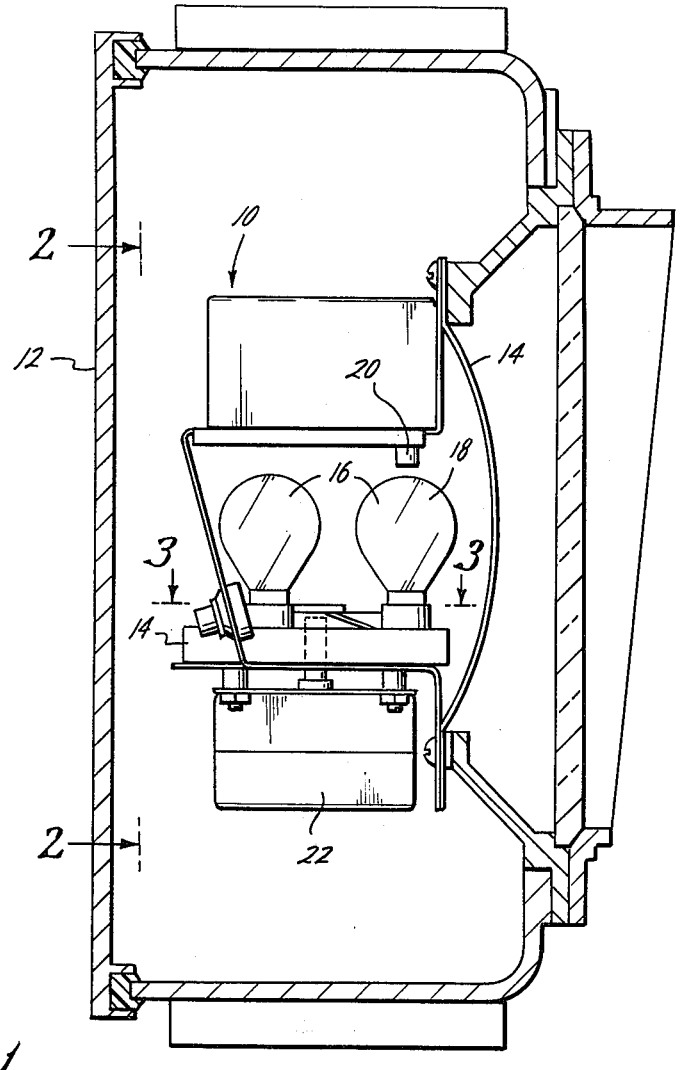
FIG. 1 is an elevational view, in cross section, of the apparatus of the present invention.
Figure 2:
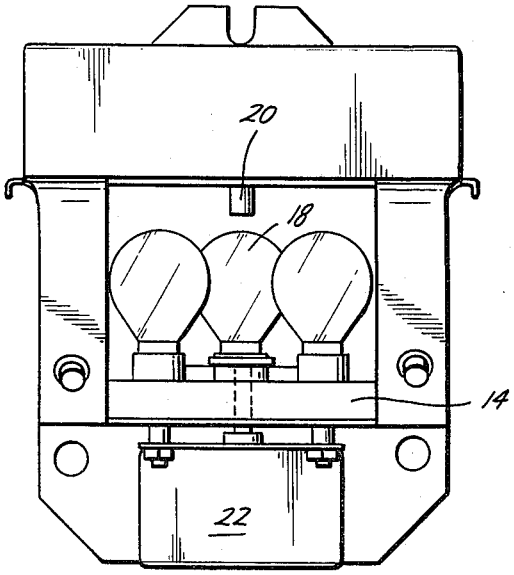
FIG. 2 is a cross-sectional view taken along the line 2—2 of FIG. 1.

Referring now to the drawings, and particularly to FIGS. 1 and 2, the present invention is directed to a lampchanger generally indicated by the reference numeral 10 which is adapted to be used in a conventional railroad signal lantern box 12 which includes a focusing lens 14. The lampchanger 10 generally includes a horizontally rotatable turret 14 for supporting a plurality of single contact bayonet base lamps 16, such as three, with one of the lamps positioned in operating position 18. A light sensing detector 20 is positioned above position 18 for viewing the filament of the lamp 16 in position 18 for determining whether or not the lamp in position 18 is lighted. A motor 22 is connected to the turret 14 and when a lamp in position 18 is burned out a control circuit actuates the motor 22 to rotate the turret 14 to bring a good lamp 16 into position 18.

Figure 3:
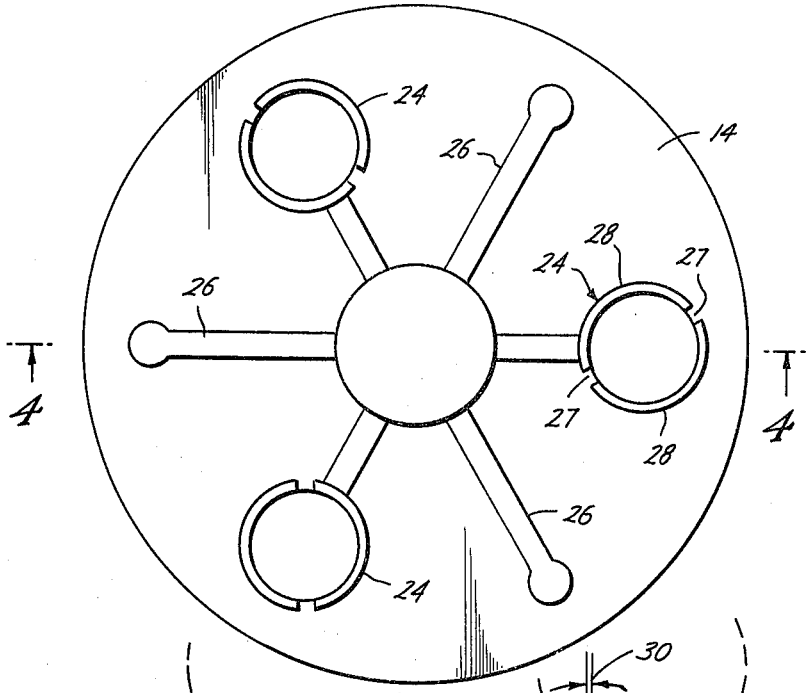
FIG. 3 is an enlarged view taken along the line 3—3 of FIG. 1.
Figure 4:
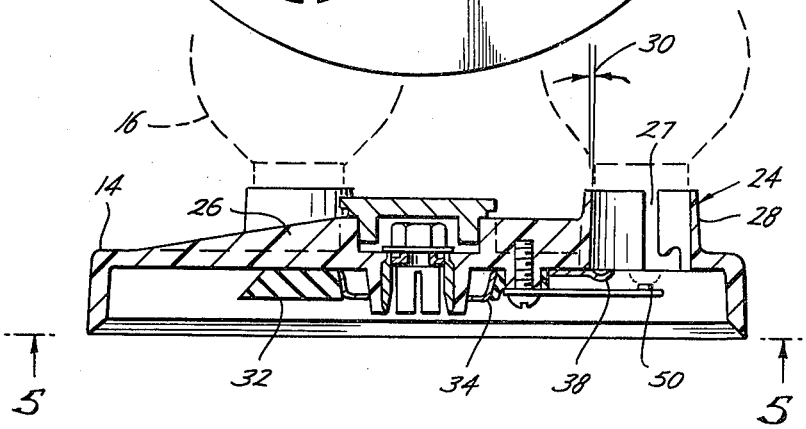
FIG. 4 is a cross-sectional view taken along the line 4—4 of FIG. 3.

Referring now to FIGS. 3 and 4, the turret 14 includes a plurality of bayonet sockets 24 and supporting ribs 26. The sockets 24, by having slots 27 therein to accommodate a bayonet type lamp 16, form generally semicircular sides 28. The turret 14 and the sides 28 are of a suitable plastic whereby the sides 28 are resilient, and as best seen in FIG. 4, taper inwardly away from the turret 14 at a slight angle such as one degree as shown by angle 30. This performs two functions. The base of the lamp 16 vary somewhat in size and the flexible sides 28 compensate for the variations in the lamp 16 base diameter, and in addition the flexible tapered sides 28 securely hold the lamp in the operating position 18 in the focus of the lens 14.

Figure 5:
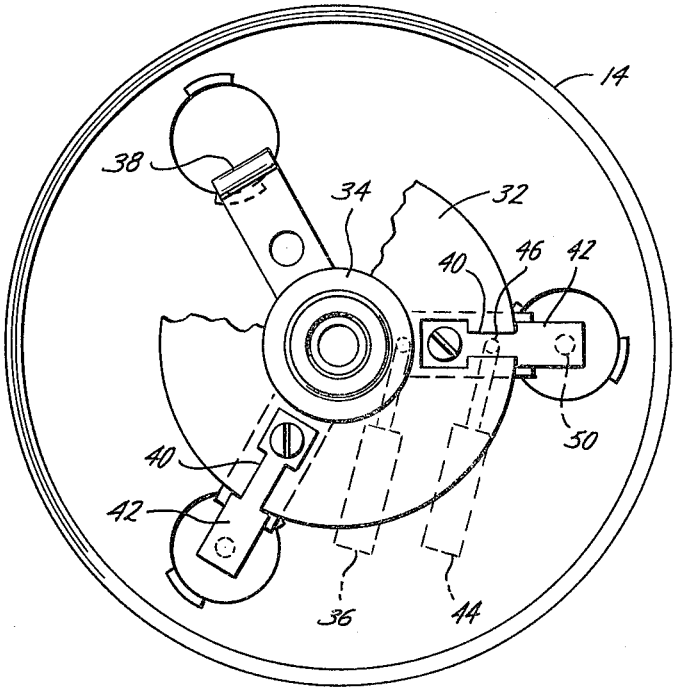
FIG. 5 is a cross-sectional view taken along the line 5—5 of FIG. 4.

Referring to FIGS. 4 and 5, an insulator 32 is secured to the bottom side of the turret 14 and acts to position and support the power contacts. One of the power contacts 34 is a common contact which is engaged by one power brush 36 at all times, and has spring-loaded ends 38 for engaging each of the bases of the lamps 16.

The insulator 32 includes a radially extending slot 40 extending towards each of the sockets 24. A second power contact 42 is positioned in each of the slots 40 for engaging the base of a lamp 16. A second power brush 44 engages the insulator 32 and includes a spherical tip 46 to fall into the slot 40 of the power contact in the operating position 18 for supplying power and lighting the lamp 16 in the position 18. When the spherical tip 46 drops into the slot 40 at the operating position, it provides a positive mechanical detent to lock the lamp 16 into the operating position 18 and prevents vibration or shock from defocusing the light. Preferably, both of the power contacts 34 and 42 are gold-plated beryllium copper strips.

The tip 50 of the power contact 42 is a hollow tubular member having a raised circular ridge which digs into the single contact of the lamp 16 when the lamp 16 is placed into the socket 28 and rotated to a locked position. This contact 50 provides a self-cleaning contact which makes a good electrical engagement with the base of the lamp 16 for piercing the normal oxide corrosion on most lamps.

Figure 6:
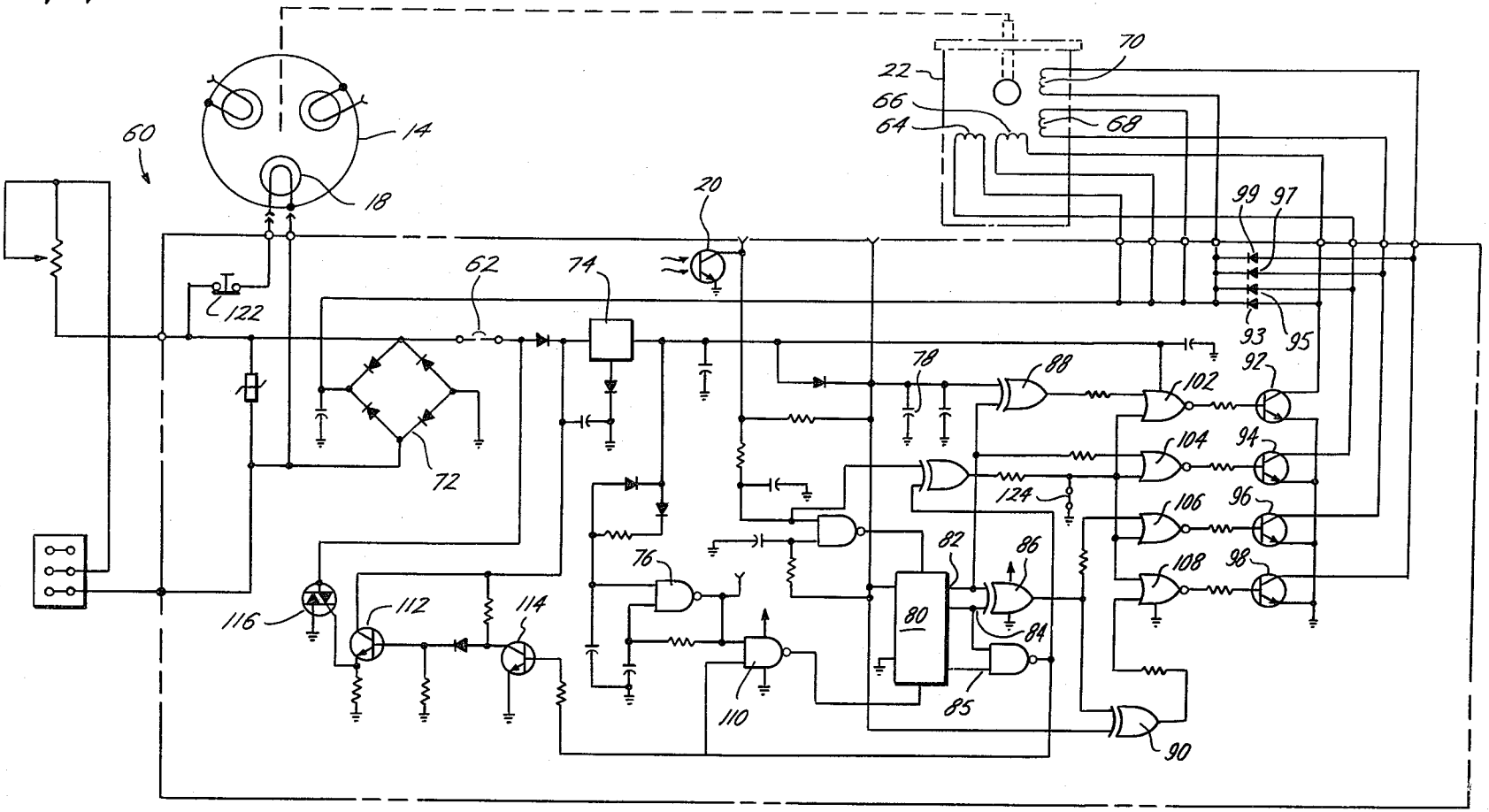
FIG. 6 is an electrical schematic of the control circuit.

Referring now to FIG. 6, a control circuit generally indicated by the reference numeral 60 is best seen for controlling the actuation of the motor 22. When electrical power is applied to the lamp in the position 18, the light detector, such as a phototransistor 20, senses the light and is interpreted by the circuit 60 as meaning that a good lamp is in position. If electrical power is applied to the lamp and no light is seen by the phototransistor 20, then the circuit 60 interprets this to mean that a new lamp is to be rotated into the position 18 to replace the burned out lamp. The electric control circuit 60 activates the motor 22 which rotates the turret 14. The circuit will allow the turret 14 to rotate a maximum of 240° at any one time. If the phototransistor 20 has still not been illuminated, the circuit 60 turns off the motor 22 and removes power from the circuit 60 by opening a circuit breaker 62. This prevents the lamp changer 16 from giving a flashing appearance from the lantern in the event of the failure of the phototransistor 20 which is an unintended signal with a different meaning in railroad operation.

Preferably, the motor 22 is a two-phase, four coil unipolar motor which provides a high degree of accuracy needed for lamp positioning. The four coils 64, 66, 68, and 70, are energized in a given sequence to advance the motor 22. Every change in the motor state causes the motor shaft to advance 7.5°. The turret 14 is initially aligned with respect to the electrical contacts so that a lamp 16 is in the operating position 18 initially. To rotate a new lamp, located 120° from the old lamp, into position requires a total of 16 steps to the motor. High current gain Darlington transistors 92, 94, 96 and 98 are used to drive the coils of the motor directly from the CMOS gates 102, 104, 106 and 108. Diodes 93, 95, 97 and 99 are provided across the transistors 92, 94, 96 and 98, respectively, in order to clamp the negative voltage spikes caused by the motor coils 64, 66, 68 and 70.

The stepper motor 22 may cause some unwanted voltage fluctuations therefore separate rectifiers are used for the motor and the control circuit. In order to keep the voltage variation to the motor as small as possible, a full wave bridge rectifier 72 is provided. The low power circuit is regulated by regulator 74.

Since power to the lampchanger 10 may be interrupted while the motor 22 is running, the circuit 60 is designed to remember what state or position the motor 22 was in at the time of interruption and to hold that state until power is regained. A NAND gate 76 is used as a gated oscillator so that when power is interrupted the oscillator 76 is disabled when in turns hold the circuit in its present state. A large capacitor 78, such as 150 microfareds, holds enough charge to power the circuit in its hold state until power is regained.

The four motor drive sequences are derived from a binary counter 80 which is clocked from the gated oscillator 76. Using the four possible states of the counter output 82 and 84, two of the required sequences are decoded by the EXCLUSIVE-OR gate 86. The remaining two sequences do not require decoding and are taken from the output 82. Gates 88 and 90 are used as inverters only.

The NOR gates 102, 104, 106 and 108 are used to disable the motor 22 whenever (a) the turret has rotated 240° without finding a good lamp or (b) when a good lamp has been found by the transistor 20. Counter 80 is used to determine if the turret has rotated 240°. When the counter has counted up to 32 motor steps the output 85 will become high, the turret 14 will have rotated 240° without finding a good lamp. At this time the counter is stopped by disabling the clock with gate 110, the circuit breaker 62 is opened using transistor 112 and 114 and triac 116 and the motor is disabled. This allows protection from a flashing appearance from the lamp in case of a failure of the phototransistor 20 and thus avoids the necessity of designating a preferred lamp position beyond which the turret 14 would not rotate. If a good lamp is found (light from a lamp in position 18 turns the transistor 20 on before the turret 14 rotates more than 240°) the counter 80 is reset to zero which corresponds to the "zero state" of the four-step sequence. The turret 14 has previously been adjusted to where a lamp is in place 18 at a "zero state".

The turret 14 adjustment mentioned above is made by using a "zero state" jumper 124. With the jumper 124 in place the motor 22 remains on while a lamp is in position 18. The shaft on the motor 22 will be held steady while the turret 18 is adjusted and secured to the motor shaft.

A test switch 122 is also provided to simulate a "bad" lamp.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A lampchanger for use in a signal lantern having a focusing lens comprising, a horizontally rotatable turret adapted to support a plurality of lamps for indexing one of the lamps to the focal point of the lens, said turret including a plurality of bayonet sockets for holding a lamp, said sockets having resilient sides which taper inwardly away from the turret body for accurately securing the lamp in position, said turret including a contact insulator having a radially extending slot adjacent each of the sockets, a power contact positioned in each of the slots, said power contact adapted to engage the bottom of a lamp positioned in a socket for making good contact with the lamp, a power brush engaging the insulator and positioned to engage the power contact of the lamp positioned in the focal point of the lens and engaging the slot of the power contact of the positioned lamp for mechanically holding a turret in position with a lamp in the focal point of the lens, and a light detector means directed at the lamp in position in the focal point of the lens for detecting whether the lamp is lighted, motor means connected to the turret for rotating the turret, and a control circuit connected to the light detector and to the motor means for actuating the motor means when the light detector detects a burned out lamp.

2. The apparatus of claim 1 wherein the control circuit includes means for preventing rotation of the turret in the event of a failure of the light detector.

3. The apparatus of claim 1 wherein the motor is a stepper motor and including a control circuit including, a binary counter actuating said coils, a gated oscillator connected to and clocking said counter for holding the counter in count in the event of loss of power, and a capacitor large enough to charge the circuit in the hold state until power is regained.

* * * * *